US007389596B2

(12) United States Patent
Parks

(10) Patent No.: US 7,389,596 B2
(45) Date of Patent: Jun. 24, 2008

(54) SHOE DRYING RACK

(76) Inventor: Todd Parks, 703 Dale St., Apt. 1, Aliquippa, PA (US) 15001

( * ) Notice: Subject to any disclaimer, the term of this patent is extended or adjusted under 35 U.S.C. 154(b) by 53 days.

(21) Appl. No.: 11/147,578

(22) Filed: Jun. 7, 2005

(65) Prior Publication Data

US 2006/0272168 A1 Dec. 7, 2006

(51) Int. Cl.
*F26B 11/02* (2006.01)
*F26B 25/00* (2006.01)

(52) U.S. Cl. ..... 34/600; 34/104; 34/106; 34/239

(58) Field of Classification Search ..... 34/201, 34/202, 600, 104, 106, 239, 440, 441; 190/13 F, 190/16, 17; 206/278, 283, 292; 220/4.21, 220/475, 4.06, 4.04; 211/34
See application file for complete search history.

(56) References Cited

U.S. PATENT DOCUMENTS 1,665,118 A * 4/1928 Thompson et al. ..... 68/143
2,236,368 A * 3/1941 Haaker ..... 206/217
2,698,689 A * 1/1955 Novack ..... 211/34
4,136,464 A 1/1979 Hay ..... 34/104
4,517,443 A 5/1985 Dollst ..... 219/215
4,530,168 A * 7/1985 Petre ..... 34/106
4,774,769 A 10/1988 Dollst ..... 34/60
4,787,153 A 11/1988 Chen ..... 34/87
5,127,529 A 7/1992 Martinez et al. ..... 211/37
5,165,181 A 11/1992 Acosta, Sr. et al. ..... 34/90
5,930,913 A 8/1999 Liao et al. ..... 34/104
5,941,259 A 8/1999 Cleveland ..... 134/95.2
5,974,693 A 11/1999 Richards et al. ..... 34/600
6,067,729 A 5/2000 Willis ..... 34/499
6,074,490 A 6/2000 Brown ..... 134/6
6,146,588 A 11/2000 Deighton ..... 422/28

* cited by examiner

*Primary Examiner*—Jiping Lu
(74) *Attorney, Agent, or Firm*—Carothers & Carothers

(57) ABSTRACT

A shoe drying rack to fit a dryer's drum, comprised of an open container divided into two mirror imaged halves joined together by an adjustable connector arm. In one embodiment, the adjustable connector arm is a telescopic arm, allowing for the sizing of the shoe drying rack to fit different size drums of a clothes dryer. A strap and holding posts located in each of the half cylinders keep one or more shoes in place during drying. A shoe drying rack in which the two containers are mirror-imaged half cylinders fits best within the round dryer drums, allowing for a large surface area of contact for stability and balance during drying.

6 Claims, 3 Drawing Sheets

SHOE DRYING RACK

FIELD OF THE INVENTION

This invention relates generally to the field of drying racks. More particularly, this invention relates to the field of shoe drying racks that fit inside the drum of a clothes dryer.

DETAILED DESCRIPTION OF EMBODIMENTS OF THE INVENTION

Figure 1:
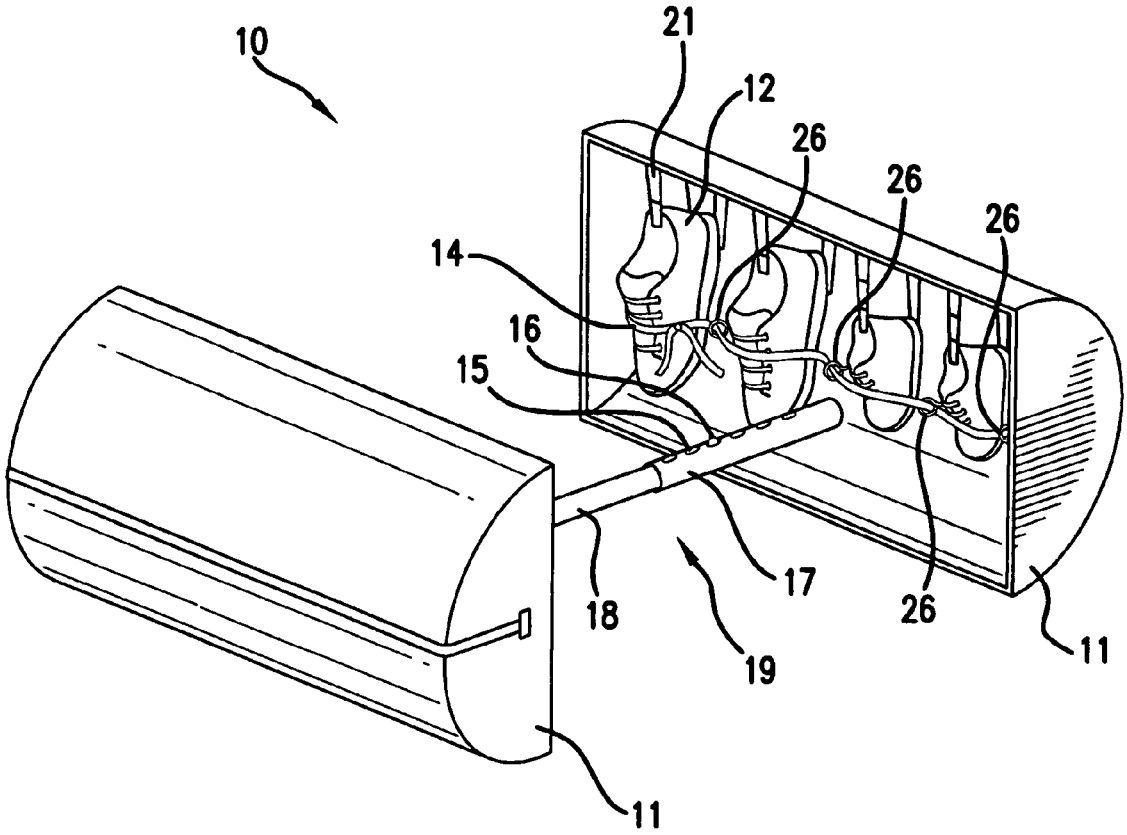
FIG. 1 is a front view of the open shoe drying rack.

For the purpose of promoting an understanding of the present invention, reference will be made to embodiments of the invention as illustrated in the drawings. It will nevertheless be understood that no limitations on the scope of the invention are thereby intended. Moreover, in the embodiments depicted, like reference numbers refer to identical structural elements in the various drawings.

The present invention is a portable shoe drying rack to be used inside the drum of a dryer. The shoe drying rack is comprised of a hollow cylinder divided into two halves connected at the center by an adjustable connector arm. The adjustable connector arm provides the tension to keep the shoe drying rack in a stable, open, and secure position inside dryer drums of varying diameters.

FIG. 1 illustrates a front perspective view of one embodiment of the present invention. As depicted, shoe drying rack 10 is constructed of two containers made of poly vinyl chloride (PVC), a sturdy plastic able to withstand heat. However, one of ordinary skill in the art will readily appreciate that any other material with similar qualities may be used in constructing shoe drying rack 10. In the embodiment depicted, the two containers of shoe drying rack 10 are two half containers 11. Shoe drying rack 10 further includes adjustable connector arm 19. Although FIG. 1 depicts each of the containers as semi-cylindrical, one of ordinary skill in the art will readily appreciate that others shapes may be used in creating the containers. Adjustable connector arm 19 is shown as being connected to half cylinders 11 at their mid points. Mid point as used herein is defined as the point roughly equidistant from the top and bottom of cylinders 11.

Figure 3:
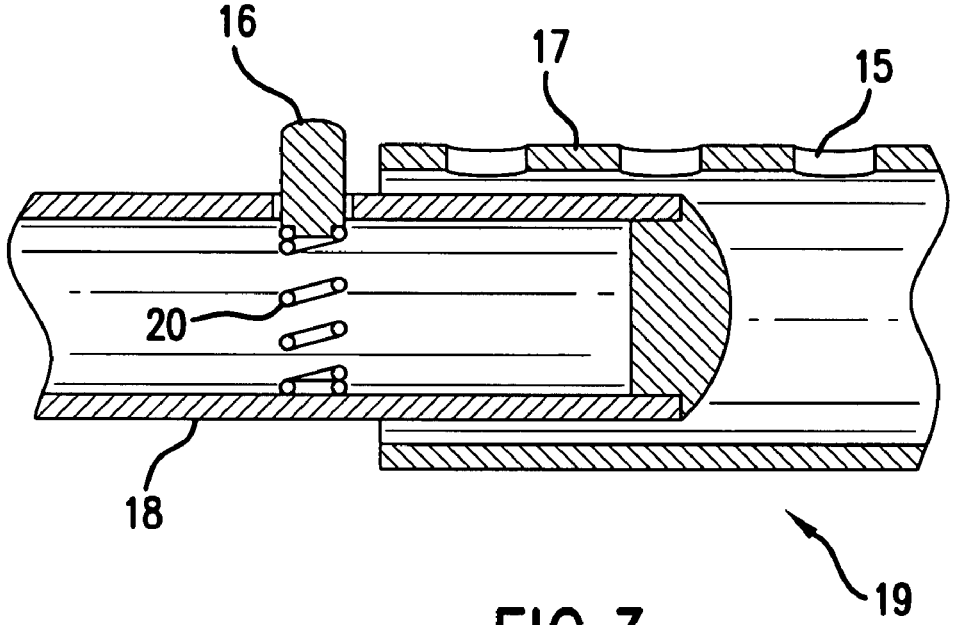
FIG. 3 is a sagittal close view of the adjustable connector arm and control button.

FIG. 3 shows a sagittal close view of adjustable connector arm 19, which, in the embodiment shown, is a telescopic arm. As can be seen from FIG. 3, adjustable connector arm 19 is comprised of two sections: first section 18 containing control button 16, and second section 17 having a plurality of holes 15. This allows telescopic arm 19 to be adjusted to different lengths. Adjustable connector arm 19 is sized by placing control button 16 into one of the holes 15 at the desired length. As further shown in FIG. 3, control button 16 is comprised of a top solid section and spring 20, which allows control button 16 to be pushed down to form a contiguous surface with first section 18. Second section 17 is slightly larger in diameter than the first section 18, permitting first section 18 to be slid into second section 17, which in turn allows control button 16 to operatively engage one of holes 15. Moreover, to change the length of telescopic arm 19, control button 16 is depressed, compressing spring 20, and first section 18 is slid inside second section 17 until reaching hole 15 present at the desired length. The pressure on control button 16 is released allowing the relaxation of spring 20 and pushing control button 16 into hole 15. In this embodiment, spring 20 is longer than the diameter of cylindrical section 18. This allows for an easier adjustment of adjustable connector arm 19, which in turn allows for the quick and easy release of control button 16. One of ordinary skill in the art will readily appreciate that other sizing mechanisms, including but not limited to pressure extension, and threading, could be used for telescopic arm 19.

Referring again to FIG. 1, holding strap 14, which is used for securing shoes 12 inside each half cylinder 11, may be appreciated in greater detail. Shoes 12 are held in place with the opening or ankle region of shoe 12 facing the opposing half cylinder 11 or adjustable connector arm 19, allowing for the entrance of air into shoe 12 for drying. In one embodiment, one or more holding straps 14 are made as an elastic pull string. However, one of ordinary skill in the art will readily appreciate that the strap could be constructed using different materials, including, but not limited to a buckle, which would allow for securing different size shoes. In the embodiment shown, at each side of a shoe mounting area, one ore more attachment rings 26 are located on the interior of each half cylinder 11. Holding strap 14 is fed through attachment ring 26, then crosses shoe 12 body and through another attachment ring 26 at the other side of shoe 12, securing shoe 12 in place. In an alternate embodiment, each half cylinder 11 has one or more holding posts 21, which hold shoes 12 in place. In an alternate embodiment, one or more adjustable holding posts 21 is present in addition to strap 14 for holding shoes 12 securely in place. The tension in the elastic strap may be adjusted by using different devices, including but not limited to a knob, buckle, a snap, or other similar objects. It should be understood that the arrangement of the strap is not intend to be limiting since alterations in the embodiments such as individual straps for each shoe are still within the spirit of the invention.

Figure 2:
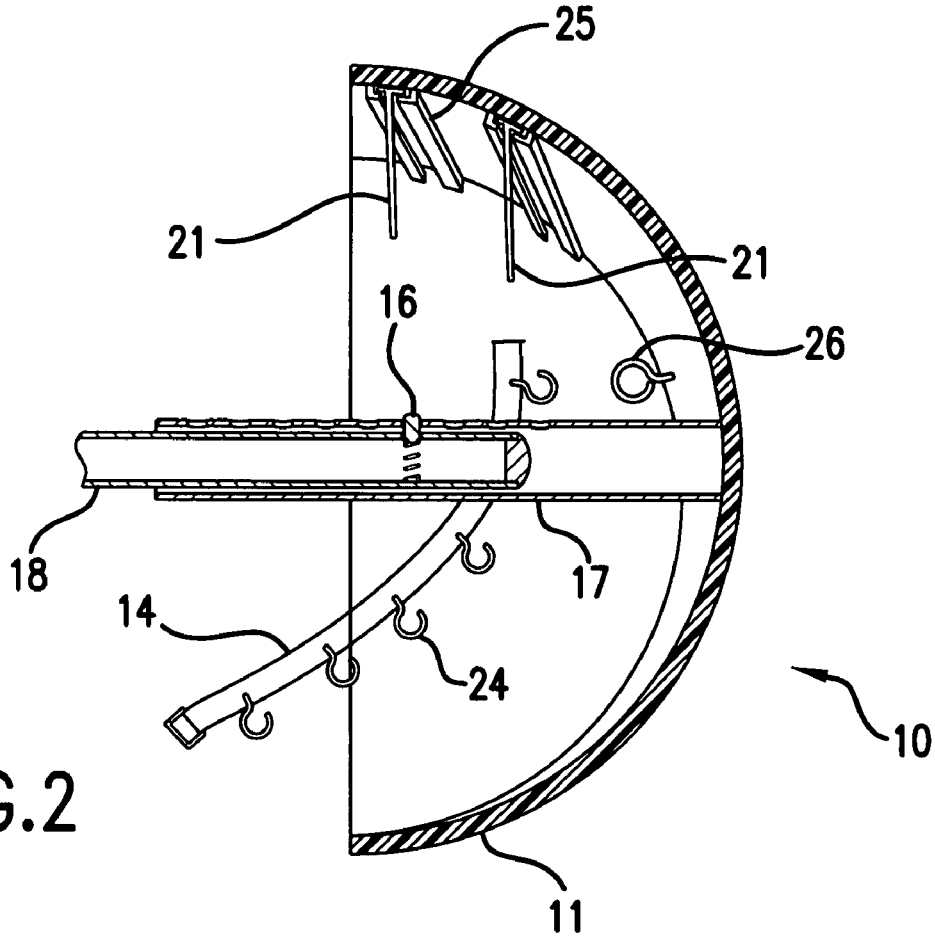
FIG. 2 is a cross section of one of the cylinders of the shoe drying rack.

FIG. 2 shows a cross-section of one half cylinder 11 of shoe drying rack 10. It can be appreciated that holding post 21 may be located in front of or behind shoe (not shown) to be held. Holding post 21 is able to stretch or retract inside track 25 to adjust its length in accordance with the size of the shoe (not shown) to be dried, i.e., an adult or a child size. Each adjustment in the length of holding post 21 is secured by a lock-in system as known in the art, keeping each holding post 21 stable and locked in place during drying. It can also be appreciated that tracks 25 for holding posts 21 are located in the upper interior area of half cylinder 11. Track 25 runs substantially the length of half cylinder 11, and allows holding posts 21 to be moved along the length of track 25 to adjust to the position and size of the shoe fitted in shoe drying rack 10 for drying. FIG. 2 also shows an alternate embodiment, wherein strap 14 has a series of hooks 24 for holding shoes. Hooks 24 engage attachment rings 26 found on the interior surface of half cylinder 11 helping secure the shoes in place.

Figure 4:
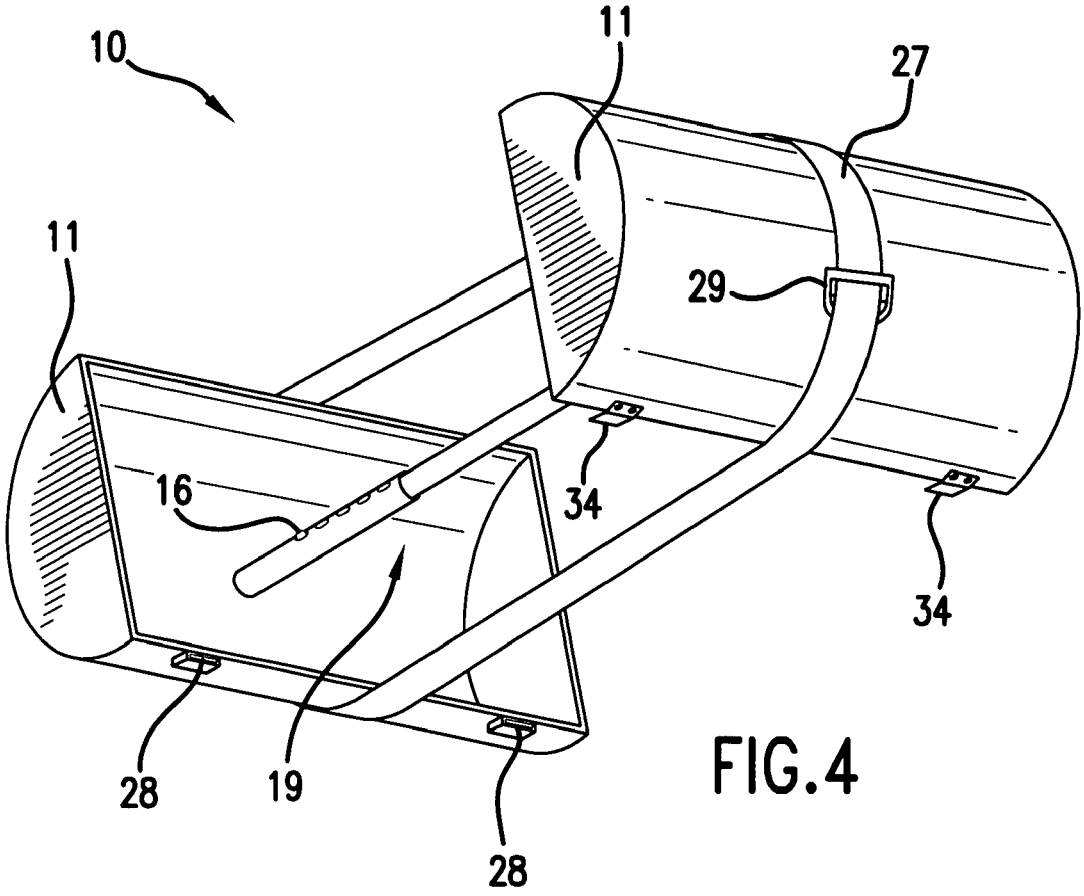
FIG. 4 is a side perspective view of an alternative embodiment of the shoe drying rack.

FIG. 4 is a side perspective view of an alternate embodiment of shoe drying rack 10. As can be appreciated in this embodiment, shoe drying rack 10 contains a set of receiving plates 28 and corresponding locking mechanisms 34. Each locking mechanism 34 attaches to receiving plate 28 to keep the two half cylinders 11 securely closed. Shoe drying rack 10 shows attachment 27 able to connect and disconnect from the body of shoe drying rack 10 as desired by the user. Attachment 27 allows shoe drying rack 10 to become a whole circle-shaped drying rack. This whole circle shape allows room for additional shoes to be dried. The attached half cylinder 11 is able to hold the same amount of shoes as half cylinder 11 to which it is connected. In this embodiment, safety latch 29 can also be appreciated. Safety latch 29 assures that each half cylinder 11 is securely snug to one another and gives extra support to that region of shoe drying rack 10. Safety latch 29 allows for the quick and easy way to connect the attachment during use. Other aspects of the drying rack are similar to the one present in the embodiment shown in FIG. 1.

Figure 5:
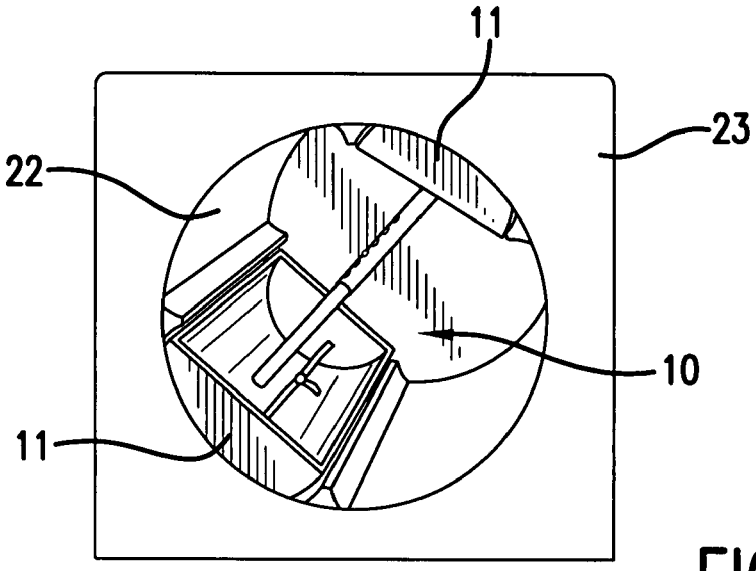
FIG. 5 is a front view of the shoe drying rack inside the drum of a dryer.

FIG. 5 is a front view of shoe drying 10 rack when placed inside drum 22 of dryer 23. In this embodiment, the exterior curve of each half cylinder 11 fits the curve of drum 22. This increases the area of contact between drum 22 and shoe drying rack 10, which in turn maximizes stability and balance during rotation of drum 22. In the embodiment shown in FIG. 5, half cylinders 11 are shown with a significant portion of drum 22 between the edges. In an alternate embodiment, the edges of each half cylinder meet or almost meet to form a substantially whole circle.

Although, for convenience, the invention has been described primarily with reference to specific embodiments, it will be apparent to those of ordinary skill in the art that the mirror assembly and the components thereof can be modified without departing from the spirit and scope of the invention as claimed.

What is claimed is:

1. A device for drying shoes comprising:

a first container, said first container having a first inner surface and a first outer surface;

a second container spaced from and independent of said first container, said second container having a second inner surface and a second outer surface;

an adjustable connector arm having a first end and a second end, said first end operatively engaged to said first inner surface of said first container and said second end operatively engaged to said second inner surface of said second container for adjustable fixing the spacing between said containers;

a first securing member adapted to secure said shoes to said first inner surface of said first container;

a second securing member adapted to secure said shoes to said second inner surface of said second container;

said first container and said second container contoured and shaped to fit within and engage interior contours of a clothes dryer drum.

2. The device of claim 1, wherein said adjustable connector arm is a telescopic arm.

3. The device of claim 1, wherein said device is constructed of a heat-resistant material.

4. The device of claim 1, wherein said first securing member and said second securing member are adjustable in length.

5. The device of claim 1, wherein said first securing member and said second securing member include at least one holding post.

6. The device of claim 1, wherein said first securing member and said second securing member comprise at least one holding strap and at least one attachment ring, said holding strap further comprised of a snap, a buckle, or a knob to adjust a length of said holding strap.

* * * * *